US005397619A

United States Patent [19]

Kuroyama et al.

[11] Patent Number: 5,397,619

[45] Date of Patent: Mar. 14, 1995

[54] INKJET RECORDING PAPER AND A MANUFACTURING PROCESS THEREOF

[75] Inventors: Yoshihiro Kuroyama; Teruhisa Shimada; Hirokazu Hirata; Yoshifumi Iimori, all of Tokyo, Japan

[73] Assignee: Nippon Paper Industries Co., Ltd., Tokyo, Japan

[21] Appl. No.: 102,939

[22] Filed: Aug. 6, 1993

[30] Foreign Application Priority Data

Aug. 7, 1992 [JP] Japan ..... 4-233183

[51] Int. Cl.[6] ..... B41M 5/00

[52] U.S. Cl. ..... 428/141; 428/195; 428/207; 428/211; 428/330; 428/331; 428/342; 428/409; 428/478.2; 428/521; 428/522

[58] Field of Search ..... 428/206, 207, 211, 409, 428/141, 195, 330, 331, 342, 478.2, 521, 522

[56] References Cited

U.S. PATENT DOCUMENTS 5,281,467 1/1994 Shimada et al. ..... 428/195

*Primary Examiner*—Pamela R. Schwartz

*Attorney, Agent, or Firm*—Millen, White, Zelano & Branigan

[57] ABSTRACT

An ink jet recording paper characterized in that it comprises a base paper wherein at least one surface has a recording layer, this recording layer containing at least 40 weight % of a pigment and no more than 60 weight % of a binder, the surface roughness by ten point height on the recording layer surface being no more than 5 μm, and the air permeability of the recording paper being no more than 1,000 seconds and a manufacturing process thereof are disclosed.

20 Claims, No Drawings

INKJET RECORDING PAPER AND A MANUFACTURING PROCESS THEREOF

FIELD OF INVENTION

This invention relates to an ink jet recording paper for recording with a water-based ink, and in particular to an ink jet recording paper which provides high recording quality.

BACKGROUND OF THE INVENTION

In ink jet recording, small ink drops are released by a variety of different mechanisms so as to form a dot image on printing paper. Unlike the case of dot impact printing, this method is not noisy, makes it easy to obtain full color images, and permits printing to be performed at high speeds.

However, as the ink used in ink jet recording is usually a water-based ink based on a direct dye or acidic dye, it has poor drying properties.

The properties required of the paper used in ink jet recording are as follows:

(1) Permits fast ink drying, (2) Permits high printing speeds, (3) Gives little spreading, tailing or blurring of dots.

Conventionally, property (1) was improved by providing an ink jet recording layer comprising a silica of large specific surface area so as to increase ink absorption. However, if the ink absorption is increased too much, the print density falls. A method was therefore developed to control the amount of voids in recording paper in order to solve this problem, as is described in Japanese Tokko Sho 63-22997.

Due to recent progress in ink jet printers and more diverse needs, a requirement has emerged for better resolution and higher image quality. However, using an ink jet recording paper having a recording layer with a pigment of large specific surface area, the recording layer surface has low smoothness. As a result, the appearance of the image was lacking in quality, the dots were not perfect circles, and the reproducibility of the image was unsatisfactory.

To improve the smoothness of the recording layer surface, conventional pigment-coated ink jet recording papers were given a supercalendar treatment or other treatment. This improved gloss and smoothness, but the porous structure of the ink jet recording layer was destroyed. Consequently, ink absorption amount and ink absorption speed declined, and drying properties were poorer.

There are also resin-coated ink jet recording papers which have a relatively smooth surface. However, as this type of paper contains almost no pigments of large specific surface area, ink absorption amount and absorption speed were low.

In ink jet recording, aqueous ink where a dye is dissolved in water are used, but if the water adheres to the paper, the image tends to blur and run after printing. In the case of resin-coated papers, water-soluble resins are generally used, so this tendency was particularly acute.

After carrying out many studies on ink jet recording papers to solve the aforesaid problems, the Inventors found it was possible to obtain a recording surface of high gloss and smoothness, obtain a large ink absorption amount and high ink absorption speed, and confer water resistance on the image. These discoveries led to the present invention.

SUMMARY OF THE INVENTION

It is therefore an object of this invention to provide an ink jet recording paper which has a recording layer of high surface smoothness, gives an image of very high quality appearance, and permits large ink absorption amount and speed.

The aforesaid objects of this invention are attained by an ink jet recording paper characterized in that it comprises a base paper wherein at least one surface has a recording layer, this recording layer containing at least 40 weight % of a pigment and no more than 60 weight % of a binder, the surface roughness by ten point height on the recording layer surface being no more than 5 μm, and the air permeability of the printing paper being no more than 1,000 seconds.

As described hereinafter, the pigment used in this invention may be selected from any of those used for ink jet recording papers known in the art, but it is preferable that its specific surface area is 40–600 $m^2/g$.

Although coated layers containing such pigments generally have good ink absorption, their surface gloss is poor. The gloss and smoothness are improved by giving the paper a supercalendar treatment or other treatment, but as this breaks down the porous structure of the paper, ink absorption declines.

According to this invention, to achieve the dual objectives of ink absorption and smoothness, a drying method is used wherein the wet surface after coating is placed in pressure contact with a heated mirror finished surface. This drying method is the same as the cast .coated paper manufacturing method defined in JISP0001 (6043).

If this method is used, the mirror finished surface is transferred without breaking down the porous structure of the coated surface, so both high ink absorption and smoothness can be attained. However, using this drying method, the air permeability is not always less than 1,000 seconds regardless of the composition of the coating solution, and in the case of for example an ordinary cast coated paper for printing, it is of the order of 1,500 seconds. Pigment-coated printing papers with an air permeability of more than 1,000 seconds have a low ink absorption and absorption speed, and consequently cannot be used for ink jet recording.

According to this invention, with a recording layer containing a pigment of specific surface area 40–600 $m^2/g$ and concurrent use of the aforesaid drying method, it has for the first time become possible to obtain an ink jet recording paper wherein the surface roughness by ten point height on the recording layer surface is no more than 5 μm, and the air permeability of the paper is no more than 1,000 seconds.

There is no particular limitation on the pigment used in the invention provided that its specific surface area is 40–600 $m^2/g$. This pigment may be chosen from any of those known in the art, for example silica, white carbon or silica gel prepared by the wet method, or superfine silica prepared by the dry method, or a material such as a calcium carbonate silica complex having a particle structure consisting of silica crystallized in calcium carbonate crystals, may also be used. Mixtures of these pigments may also be used. In particular, if a calcium carbonate silica complex is used, a recording layer having an excellent gloss can be obtained.

According to this invention, the blending proportion of pigment in the recording layer is preferably 40 weight % or more, but more preferably lies in the range 45 weight % to 80 weight %.

There is no particular limitation on the binder used in the invention provided that it is an aqueous binder. This binder may be chosen from resins known in the art such as casein, starch, polyvinyl alcohol, carboxymethyl-cellulose, styrene-butadiene latex and vinyl acetate emulsions, these resins being used either alone or in admixture. In particular, if the gelation cast coating method, which is a coagulation method, is used, the resin used is preferably casein. The blending proportion of the binder in the recording layer is preferably no more than 60 weight %, but more preferably lies in the range 20 weight % to 55 weight %.

According to this invention, it is preferable to use a cationic polymer electrolyte concurrently with the aforesaid binding agent. This electrolyte reacts with anionic groups such as sulfonic acid in the water-soluble direct dye or water-soluble acidic dye molecule so as to form salts which are insoluble in water, thereby improving the water resistance of the recorded image.

Examples of such cationic polymer electrolytes are polyvinylbenzyltrimethylammonium halide, polydiacryldimethylammonium halide, polydimethylaminoethylmethacrylate hydrochloride, polyethyleneimine, dicyandiamideformalin condensate, epichlorhydrin modified polyalkylamine, polyvinylpyridium halide, quaternary ammonium salts and polyamines. The blending proportion of the cationic polymer electrolyte is preferably 1–30 weight %, but more preferably 5–20 weight %, of the total weight of binder.

The ink jet recording layer according to this invention may if necessary, in addition to the aforesaid pigments and binders, also contain various additives such as dispersants, antifoaming agents, dyes or fluidity modifying agents.

The ink jet recording layer according to this invention may be applied by any suitable coating method known in the art using a coating tool such as a blade coater, air knife coater, curtain coater, bar coater, gravure coater or comma coater.

The coating weight is 2–50 g/m$^2$ but preferably 6–30 g/m$^2$ in terms of solids on each surface, this amount being adjusted as desired so as to cover the surface of the base paper and obtain sufficient ink absorption.

The ink jet recording layer according to this invention is dried, as described hereintofore, by bringing the wet coated surface into pressure contact with a heated mirror finished surface. There are the following three kinds of the coated layer state; (1) the state obtained immediately after coating before the coating has dried, (2) the state obtained by gelating the coating before it has dried, (3) the plasticized state obtained by re-wetting the coating after drying it.

According to this invention, of the aforesaid states, it is preferable to use the gelated state. Typical coagulating agents used in the coagulation method are for example the calcium, zinc, barium, lead, magnesium, cadmium or aluminum salts of formic acid, acetic acid, citric acid, tartaric acid, lactic acid, hydrochloric acid or sulfuric acid, or potassium sulfate, borax or boric acid. The salts of formic acid are most preferable in this invention.

The heated mirror finished surface used in this invention generally refers to a drum having a mirror-polished cylindrical outer surface heated to about 100° C.

Examples of the base paper used in this invention are ordinary wood-free or mechanical papers.

The recording paper of this invention may be used for ordinary Offset printing or the like, or it may be used as PPC paper.

As described hereintofore, by selecting the composition of the coated layer and drying method, the ink jet recording paper of this invention gives not only gloss but also improved smoothness of the recording surface, provides high ink absorption and ink absorption speed, and confers water resistance on the image. Further, as the surface has high smoothness, the image has a high quality appearance, and as the dots produced are almost perfectly round, the image has excellent reproducibility.

EXAMPLES

This invention will now be described in more detail by means of specific examples, but it will be understood that it is not to be construed as being limited by these examples in any way.

Example 1

A 30% concentration coating solution comprising, in terms of solid composition, 60 weight % of a calcium carbonate silica complex of specific surface area 60 m$^2$/g (Finesil CM-F: Tokuyama Soda co. Ltd. ) as pigment; 35 weight % of casein (lactic casein from New Zealand); 4 weight % of the quaternary ammonium salt of polyethyleneimine as binder; and 1 weight % of calcium stearate (Nopcoat C-104: San nopco Co. Ltd.) as releasing agent, was applied by a roll coater to a wood-free paper of weighting 90 g/m$^2$ and air permeability 45 seconds. The coating was then coagulated by applying a 10 weight % aqueous solution of calcium formate.

Next, while the coated layer was still wet, it was brought into pressure contact with the mirror surface of a casting drum heated to 90° C. so as to dry it, thereby obtaining an ink jet recording paper according to this invention. The coating weight in this case was 19.0 g/m$^2$ in terms of dry weight. The following tests were performed on the ink jet recording paper obtained, and the results are shown in Table 1.

(1) Surface roughness by ten point height

Measured according to JIS B0601.

(2) Air permeability

Measured by an Oken type Air Permeability Tester according to J. TAPPI No. 5B (3) Gloss at 75 degree Measured according to JIS Z8741.

(4) Dot density

After printing with a color ink jet printer (IO-725: Sharp Co. Ltd. ), the reflection density was measured using a Konica Microdensitometer PDM-5 (Konica Co. Ltd. ), and expressed as an average value for 5 dots.

(5) Roundness coefficient

The dot circumference and area were measured using an image analyzer (ADS Co.Ltd), and the value obtained by the following equation was taken as the roundness coefficient:

$$\text{Roundness coefficient} = \frac{1}{\frac{(\text{Circumference})^2}{\text{Area}} \times \frac{1}{4\pi}}$$

EXAMPLE 2

A 30% concentration coating solution comprising, in terms of solid composition, 40 weight % of a synthetic silica of specific surface area 600 $m^2/g$ (Syloid 600: Fuji Davison co. Ltd.) as pigment; 15 weight % of styrene butadiene latex (JSR-0801: Japan Synthetic Rubber co Ltd. ); 20 weight % of polyvinyl-alcohol (PVA-117: Kuraray co. Ltd. ); 20 weight % of casein; 4 weight % of the quaternary ammonium salt of polyethyleneimine as binder; and 1 weight % of calcium stearate as releasing agent, was applied by a roller to a wood-free paper of weighting 90 $g/m^2$ and air permeability 45 seconds, as in Example 1. The coating was then coagulated by applying a 10 weight % aqueous solution of calcium formate. Next, while the coated layer obtained was still wet, it was brought into pressure contact with the mirror surface of a casting drum heated to 90° C. so as to dry it, thereby obtaining an ink jet recording paper according to this invention wherein the coating weight was 16.0 $g/m^2$ in terms of dry weight. The results of tests performed on the ink jet recording paper thus obtained are shown in Table 1.

Example 3

A 30% concentration coating solution comprising, in terms of solid composition, 60 weight % of a calcium carbonate silica complex of specific surface area 80 $m^2/g$ (Finesil CM-F) as pigment; 15 weight % of styrene butadiene latex (JSR-0801: Japan Synthetic Rubber co. Ltd.); 20 weight % of casein (lactic casein from New Zealand); 4 weight % of the polydimethylaminoethylmethacrylate chloride as binder; and 1 weight % of calcium stearate as releasing agent, was applied by a roller coater to a wood-free paper of weighting 90 $g/m^2$ and air permeability 45 seconds as described in Example 1. Next, the coating was coagulated by applying a 10 weight % aqueous solution of calcium formate and brought into pressure contact with the mirror surface of a casting drum heated to 90° C. so as to dry it, thereby obtaining an ink jet recording paper according to this invention wherein the coating weight was 14.0 $g/m^2$ in terms of dry weight. The results of tests performed on the ink jet recording paper thus obtained are shown in Table 1.

Comparative Example 1

A recording paper was obtained by exactly the same procedure as in Example 1, excepting that a synthetic silica of specific surface area 30 $m^2/g$ (Finesil SP-20: Tokuyama Soda co.Ltd.) was used instead of the calcium carbonate silica complex (Finesil CM-F) used as pigment in Example 1. The coating weight of the recording paper obtained was 18.0 $g/m^2$ in terms of dry weight. The test results are shown in Table 1.

Comparative Example 2

A recording paper was obtained by exactly the same procedure as in Example 2, excepting that a synthetic silica of specific surface area 700 $m^2/g$ (FK700: Degusa Ltd. ) was used instead of the synthetic silica (Syloid 600) used as pigment in Example 2. The coating weight of the recording paper obtained was 16.0 $g/m^2$ in terms of dry weight. The test results are shown in Table 1.

Comparative Example 3

A 30% concentration coating solution having exactly the same solid composition as that of Example 1, was applied by a roller coater to a paper of weighting 90 $g/m^2$. The coating was air-dried in the normal way without coagulation, and then given a supercalendar treatment so as to obtain a recording paper. The coating weight of the recording paper obtained was 18.5 $g/m^2$ in terms of dry weight. The test results are shown in Table 1.

Comparative Example 4

A recording paper was obtained by exactly the same procedure as in Example 1, excepting that a coating layer was obtained having a solid composition of 5 weight % of the silica of specific surface area 60 $m^2/g$ (Finesil CM-F) used as pigment in Example 1, 90 weight % of casein, 4 weight % of the quaternary ammonium salt of poly-ethyleneimine as binder and 1 weight % of calcium stearate as releasing agent. The coating amount of the recording paper obtained was 19.0 $g/m^2$ in terms of dry weight. The test results are shown in Table 1.

Comparative Example 5

A test was performed using a commercial cast coated paper of weighting 93 $g/m^2$ ( Espricoat F: Nippon Paper Industries co. Ltd. ). The test results are shown in Table 1.

TABLE 1

| | Pigment type | Pigment specific surface area ($m^2/g$) | Pigment blending proportion in coating layer (wt %) | Drying method | Coating weight ($g/m^2$) | surface roughness by ten point height (μm) | Air permeability (sec) | gloss at 75 degree (%) | Ink absorption | Dot density | Roundness coefficient |
|---|---|---|---|---|---|---|---|---|---|---|---|
| Example 1 | Calc. carb. silica complex | 60 | 60 | Mirror surface pressure contact | 19.0 | 1.0 | 750 | 86.3 | ○ | 0.88 | 0.83 |
| Example 2 | Synthetic silica | 600 | 40 | Mirror surface pressure contact | 16.0 | 3.5 | 650 | 78.5 | ○ | 0.76 | 0.79 |
| Example 3 | Calc. carb. silica complex | 80 | 40 | Mirror surface pressure contact | 16.0 | 1.9 | 710 | 88.2 | ○ | 0.83 | 0.75 |
| Comparative Example 1 | Synthetic silica | 30 | 60 | Mirror surface pressure contact | 18.0 | 1.0 | 900 | 68.3 | X | 0.73 | 0.49 |
| Comparative Example 2 | Synthetic silica | 700 | 40 | Mirror surface pressure contact | 16.0 | 3.3 | 530 | 83.3 | ○ | 0.63 | 0.71 |

TABLE 1-continued

| | Pigment type | Pigment specific surface area ($m^2/g$) | Pigment blending proportion in coating layer (wt %) | Drying method | Coating weight ($g/m^2$) | surface roughness by ten point height (μm) | Air permeability (sec) | gloss at 75 degree (%) | Ink absorption | Dot density | Roundness coefficient |
|---|---|---|---|---|---|---|---|---|---|---|---|
| Comparative Example 3 | Calc. carb. silica complex | 60 | 60 | Air drying | 18.5 | 9.5 | 250 | 5.5 | ○ | 0.81 | 0.40 |
| Comparative Example 4 | Calc. carb. silica complex | 60 | 5 | Mirror surface pressure contact | 19.0 | 1.0 | 1300 | 90.5 | X | 0.93 | 0.79 |
| Comparative Example 5 | — | — | — | Mirror surface pressure contact | — | 0.7 | 1500 | 89.7 | X | 0.38 | Measurement impossible |

In the table, calc. carb. refers to calcium carbonate

What is claimed is:

1. An ink jet recording paper comprising a base paper with at least one surface thereof having a recording layer thereon containing at least 40 weight % of a pigment having a specific surface area of 40–600 $m^2/g$, and no more than 60 weight % of a binder, wherein the surface roughness by ten point height on the recording layer surface is no more than 5 μm, the gloss of the recording layer surface at 75 degrees according to JIS Z8741 is 70% or more, and the air permeability of the whole recording paper is no more than 1,000 seconds.

2. An ink jet recording paper as defined in claim 1 wherein the pigment is at least one pigment selected from silica, white carbon or silica gel each obtained by the wet method, superfine silica obtained by the dry method, or a calcium carbonate silica complex having a particle structure consisting essentially of silica crystallized in calcium carbonate crystals.

3. An ink jet recording paper as defined in claim 2 wherein the pigment comprises a calcium carbonate silica complex having a particle structure consisting essentially of silica crystallized in calcium carbonate crystals.

4. An ink jet recording paper as defined in claim 1, wherein the recording layer comprises 45 weight %–80 weight % of said pigment.

5. An ink jet recording paper as defined in claim 1, wherein the binder is a water-soluble binder.

6. An ink jet recording paper as defined in claim 1 wherein the binder is at least one binder selected from casein, starch, polyvinyl alcohol, and carboxymethylcellulose.

7. An ink jet recording paper as defined in claim 1, wherein the binder comprises a resin coagulated by a salt of formic acid.

8. An ink jet recording paper as defined in claim 7 wherein the resin comprises casein.

9. An ink jet recording paper as defined in claim 7 wherein the resin consists or casein.

10. An ink jet recording paper as defined in claim 1, wherein the binder comprises a resin and a cationic polymer electrolyte.

11. An ink jet recording paper as defined in claim 10 wherein the cationic polymer electrolyte content is 1–30 weight % of the total amount of binder.

12. An ink jet recording paper as defined in claim 11 wherein the cationic polymer electrolyte content is 5–20 weight % of the total amount of binder.

13. An ink jet recording paper as defined in claim 1 wherein the coating weight of the recording layer is 2–50 $g/m^2$.

14. The ink jet recording paper of claim 1, which is prepared by a process comprising coating the base paper with a coating solution of the recording layer containing the pigment and binder and bringing the recording layer, while still wet, into contact under pressure with a heated mirror-finished surface to dry the layer.

15. The ink jet recording paper of claim 14, wherein the binder in the recording layer is coagulated with a coagulation agent while the layer is still wet.

16. The ink jet recording paper of claim 15, wherein the coagulation agent is at least one agent selected from salts of formic acid, acetic acid, citric acid, tartaric acid, lactic acid, hydrochloric acid and sulfuric acid; potassium sulfate, borax or boric acid.

17. The ink jet recording paper of claim 16, wherein the coagulation agent is a salt of formic acid.

18. The ink jet recording paper of claim 17, wherein the binder comprises casein.

19. An ink jet recording paper as defined in claim 1, wherein an aqueous emulsion of a binder or a mixture of a water-soluble binder in an aqueous emulsion of a binder is used to provide the binder.

20. An ink jet recording paper of claim 1, wherein the binder is provided from a styrene-butadiene latex or a vinyl acetate emulsion.

* * * * *